US008246034B2

(12) United States Patent
Tsuchiya

(10) Patent No.: US 8,246,034 B2
(45) Date of Patent: Aug. 21, 2012

(54) SHEET PROCESSING APPARATUS AND A SHEET PROCESSING METHOD

(75) Inventor: Katsuhiko Tsuchiya, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/873,244

(22) Filed: Aug. 31, 2010

(65) Prior Publication Data

US 2011/0062647 A1 Mar. 17, 2011

Related U.S. Application Data

(60) Provisional application No. 61/242,717, filed on Sep. 15, 2009.

(51) Int. Cl.
*B65H 37/04* (2006.01)

(52) U.S. Cl. ..... 270/58.12; 270/58.07; 270/58.08; 270/58.09; 270/58.11; 270/58.17

(58) Field of Classification Search ..... 270/58.07, 270/58.08, 58.09, 58.11, 58.12, 58.13, 58.17, 270/58.27, 58.28
See application file for complete search history.

(56) References Cited

U.S. PATENT DOCUMENTS

| | | | | |
|---|---|---|---|---|
| 4,657,239 | A * | 4/1987 | Ikesue et al. | 271/227 |
| 4,917,366 | A * | 4/1990 | Murakami et al. | 270/58.09 |
| 5,590,871 | A * | 1/1997 | Okabe et al. | 270/58.27 |
| 6,088,568 | A * | 7/2000 | Ohtani | 399/408 |
| 6,382,615 | B1 * | 5/2002 | Ishiguro et al. | 270/58.12 |
| 7,300,045 | B2 | 11/2007 | Terao | |
| 7,407,156 | B2 * | 8/2008 | Iizuka et al. | 270/58.11 |
| 7,648,136 | B2 | 1/2010 | Terao | |
| 7,669,847 | B2 * | 3/2010 | Yamaguchi | 271/220 |

FOREIGN PATENT DOCUMENTS

JP P2002-104720 4/2002

* cited by examiner

*Primary Examiner* — Leslie A Nicholson, III
(74) *Attorney, Agent, or Firm* — Patterson & Sheridan, LLP

(57) ABSTRACT

According to an embodiment, a sheet processing apparatus includes: a processing tray on which a sheet conveyed from an image forming apparatus is placed; a lateral alignment unit which has a pair of movable alignment boards, holds and the sheet on the processing tray between the pair of alignment boards, and aligns the sheet; a stapler which staples the sheet placed on the processing tray; a sheet discharge unit which discharges the stapled sheet from the processing tray to a discharge port; and a control unit which control so that the sheet is stapled after an operation of holding the sheet between the pair of alignment boards and then opening the alignment boards is performed plural times, when the sheet is inserted to the stapler from the discharge port and manually stapled.

18 Claims, 15 Drawing Sheets

SHEET PROCESSING APPARATUS AND A SHEET PROCESSING METHOD

CROSS-REFERENCE TO RELATED APPLICATION

This application is based upon and claims the priority of U.S. Provisional Application No. 61/242,717, filed on Sep. 15, 2009, the entire contents of which are incorporated herein by reference.

FIELD

Embodiments described herein relate generally to a sheet processing apparatus and a sheet processing method for stapling sheets discharged from an image forming apparatus such as copier, printer or multi-function peripheral (MFP).

BACKGROUND

Recently, a sheet processing apparatus is arranged at a place near and following an image forming apparatus (for example, MFP) in order to finish sheets after image formation. The sheet processing apparatus is called finisher and staples or sorts and then discharges sheets send from the MFP.

The finisher has a lateral alignment unit which controls the position of sheets in a direction of the width. The finisher aligns sheets in the direction of the width and then staples the sheets with a stapler. The lateral alignment unit is also used to sort and discharge sheets. Sheets may also be stapled by manual operation. When manually stapling sheets, a sheet bundle is inserted toward the stapler from a sheet discharge port of the finisher and the stapler is then operated. However, in manual stapling, the sheet bundle cannot be correctly stapled in some cases because the sheet bundle is not aligned or the stapling position is shifted.

DETAILED DESCRIPTION

Figure 1:
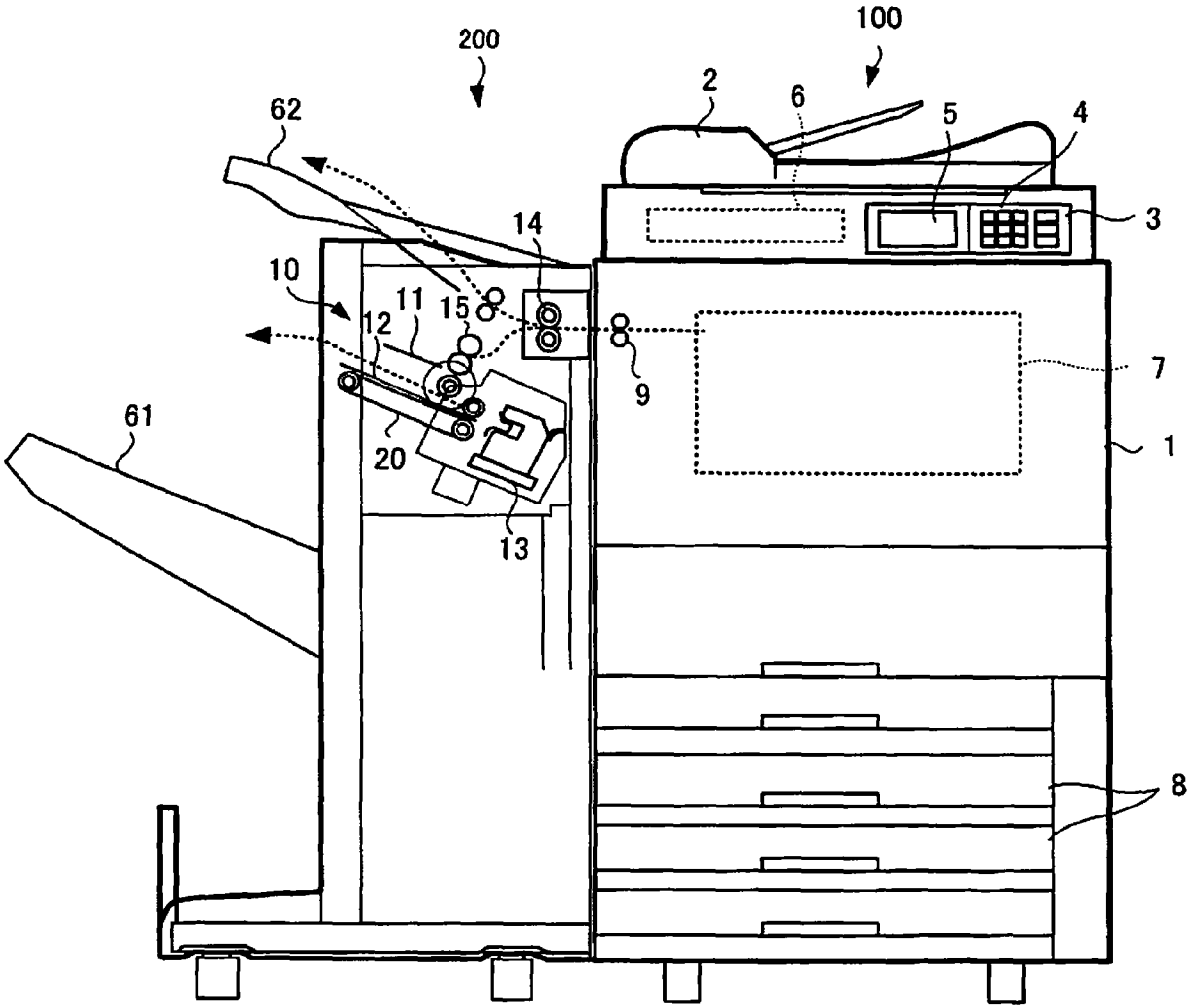
FIG. 1 is an overall configuration view showing an embodiment of a sheet processing apparatus.

According to an embodiment, a sheet processing apparatus includes: a processing tray on which a sheet conveyed from an image forming apparatus is placed; a lateral alignment unit which has a pair of alignment boards movable in a direction orthogonal to a direction of the conveying, holds the sheet on the processing tray between the pair of alignment boards and aligns the sheet; a stapler which staples the sheet placed on the processing tray; a sheet discharge unit which discharges the stapled sheet from the processing tray to a discharge port; and a control unit which control so that the sheet is stapled after an operation of holding the inserted sheet between the pair of alignment boards and then opening the alignment boards is performed plural times, when the sheet is inserted to the stapler from the discharge port and manually stapled.

Hereinafter, a sheet processing apparatus according to an embodiment will be described in detail with reference to the drawings. In the drawings, the same parts are denoted by the same reference numerals.

FIG. 1 is a configuration view showing an image forming apparatus having a sheet processing apparatus. In FIG. 1, 100 represents an image forming apparatus, for example, MFP (multi-function peripherals), printer or copier. A sheet processing apparatus 200 is arranged near the image forming apparatus 100. The sheet processing apparatus 200 is hereinafter referred to as finisher 200.

A sheet on which an image is formed by the image forming apparatus 100 is conveyed from the image forming apparatus 100 to the finisher 200. The finisher 200 performs finishing of the sheet conveyed from the image forming apparatus 100, for example, stapling, sorting and the like.

A document table is provided in an upper part of a body 1 of the image forming apparatus 100. An automatic document feeder (ADF) 2 is provided to be freely open and close on the document table. An operation panel 3 is provided in an upper part of the body 1. The operation panel 3 has an operation unit 4 having various keys and a touch panel display unit 5.

A scanner unit 6 and a printer unit 7 are provided inside the body 1. In a lower part of the body 1, plural cassettes 8 hosing sheets of various sizes are provided. The scanner unit 6 scans a document sent by the ADF 2 or a document placed on the document table.

The printer unit 7 includes a photoconductive drum, a laser and the like. The printer unit 7 scans and exposes the surface of the photoconductive drum with a laser beam from the laser and thus creates an electrostatic latent image on the photoconductive drum. On the periphery of the photoconductive drum, a charger, a developing device, a transfer device and the like are arranged. The electrostatic latent image on the photoconductive drum is developed by the developing device and a toner image is thus formed on the photoconductive drum. The toner image is transferred to a sheet by the transfer device. The configuration of the printer unit 7 is not limited the above example and various systems can be employed.

A sheet on which an image is formed in the body 1 is conveyed to the finisher 200 by a discharge roller 9. In example shown in FIG. 1, the finisher 200 has a stapling unit 10 which staples a sheet bundle. The sheet finished by the finisher 200 is discharged to a storage tray 61 or a fixed tray 62. The storage tray 61 can move up and down.

Figure 2:
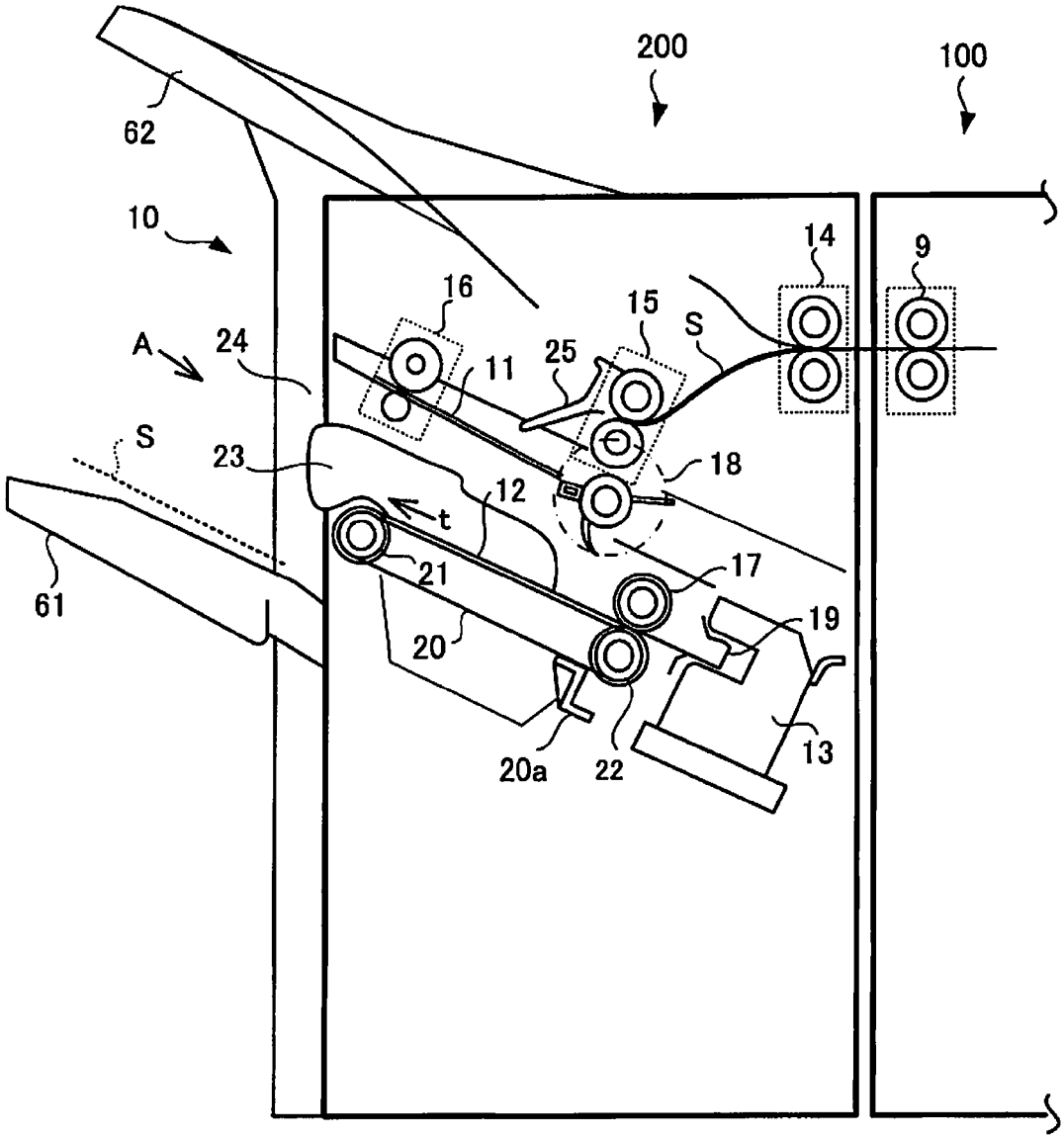
FIG. 2 is a configuration view of the finisher.

FIG. 2 is a configuration view of the stapling unit 10 of the finisher 200. A sheet S discharged from the discharge roller 9 of the image forming apparatus 100 is conveyed to the stapling unit 10.

The stapling unit 10 has a standby tray 11, a processing tray 12, and a stapler 13. The sheet S discharged by the discharge roller 9 of the image forming apparatus 100 is received by an inlet roller 14 provided at the inlet of the stapling unit 10. The inlet roller 14 includes an upper roller and a lower roller and is driven by a motor.

A paper feed roller 15 is provided downstream of the inlet roller 14. The sheet S received by the inlet roller 14 is sent to the standby tray 11 via the paper feed roller 15. The paper feed roller 15 includes an upper roller and a lower roller. The paper feed roller 15 is driven by a motor. Below the standby tray 11, the processing tray 12 is arranged on which the sheet S falling from the standby tray 11 is stacked.

The standby tray 11 has a structure that enables the stacking of the sheet S and the opening of the standby tray. When a predetermined number of sheets S are accumulated, the standby tray 11 opens and the sheets S fall onto the processing tray 12 by their own weight or are made to fall thereon by the activation of a fall assisting member which forces the sheets to fall. The processing tray 12 supports the sheets S while the sheets S are stapled by the stapler 13.

The sheets falling onto the processing tray 12 are led to the stapler 13 by a roller 17 and stapled. The roller 17 is driven by a motor. The roller 17 rotates in the opposite directions for leading the sheets S toward the stapler 13 and for discharging the stapled sheets S.

When stapling the sheets, the plural sheets S falling onto the processing tray 12 from the standby tray 11 are aligned in a longitudinal direction, which is the direction of conveying, and aligned in a lateral direction orthogonal to the direction of conveying. The sheets S are thus stapled. A lateral alignment unit 23 is provided in order to laterally align the sheets S. The lateral alignment unit 23 aligns and sorts the sheets S (as will be described in detail later). The stapler 13 and the lateral alignment unit 23 form a finishing unit in the stapling unit 10 and perform finishing such as stapling and sorting.

In order to assist the sheets S in falling onto the processing tray 12, a rotatable paddle 18 is provided at a position where the rear end of the sheets S falls. The paddle 18 is attached to a rotary shaft. The paddle 18 strikes the sheets S falling from the standby tray 11 down onto the processing tray 12 and sends the sheets S toward the stapler 13.

At the end of the processing tray 12 on the stapler 13 side, a stopper 19 is provided which regulates the rear end position of the sheets S. Moreover, a conveyance belt 20 is provided in order to convey the sorted or stapled sheets S to the storage tray 61. The conveyance belt 20 is laid between pulleys 21 and 22. A pawl member 20*a* which catches and sends the rear end of the sheets S is attached to the conveyance belt 20. The description of a mechanism to rotate the pulleys 21 and 22 is omitted.

As the conveyance belt 20 turns in the direction of arrow t, the sheets S are discharged from a discharge port 24 to the storage tray 61. The storage tray 61 is moved up and down by a motor and receives the sheets S. The conveyance belt 20 and the pawl member 20*a* form a sheet discharge unit to lead the stapled sheets S to the discharge port 24.

When discharging the sheets S stacked on the standby tray 11 to the storage tray 61 without stapling, the sheets S are discharged by a rotary roller 16 without being made to fall onto the processing tray 12. The sheets S that do not require stapling can also be discharged to the fixed tray 62. A conveying path to lead the sheets S to the fixed tray 62 is provided. To the attachment shaft of the upper roller of the paper feed roller 15, an assisting arm 25 is attached in such a manner that the assisting arm 25 can swing. The assisting arm 25 is protruding to the discharge side of the paper feed roller 15 and presses and holds the rear end of the sheets S discharged from the paper feed roller 15 onto the standby tray 11 so that the rear end of the sheets S do not float.

Figure 3:
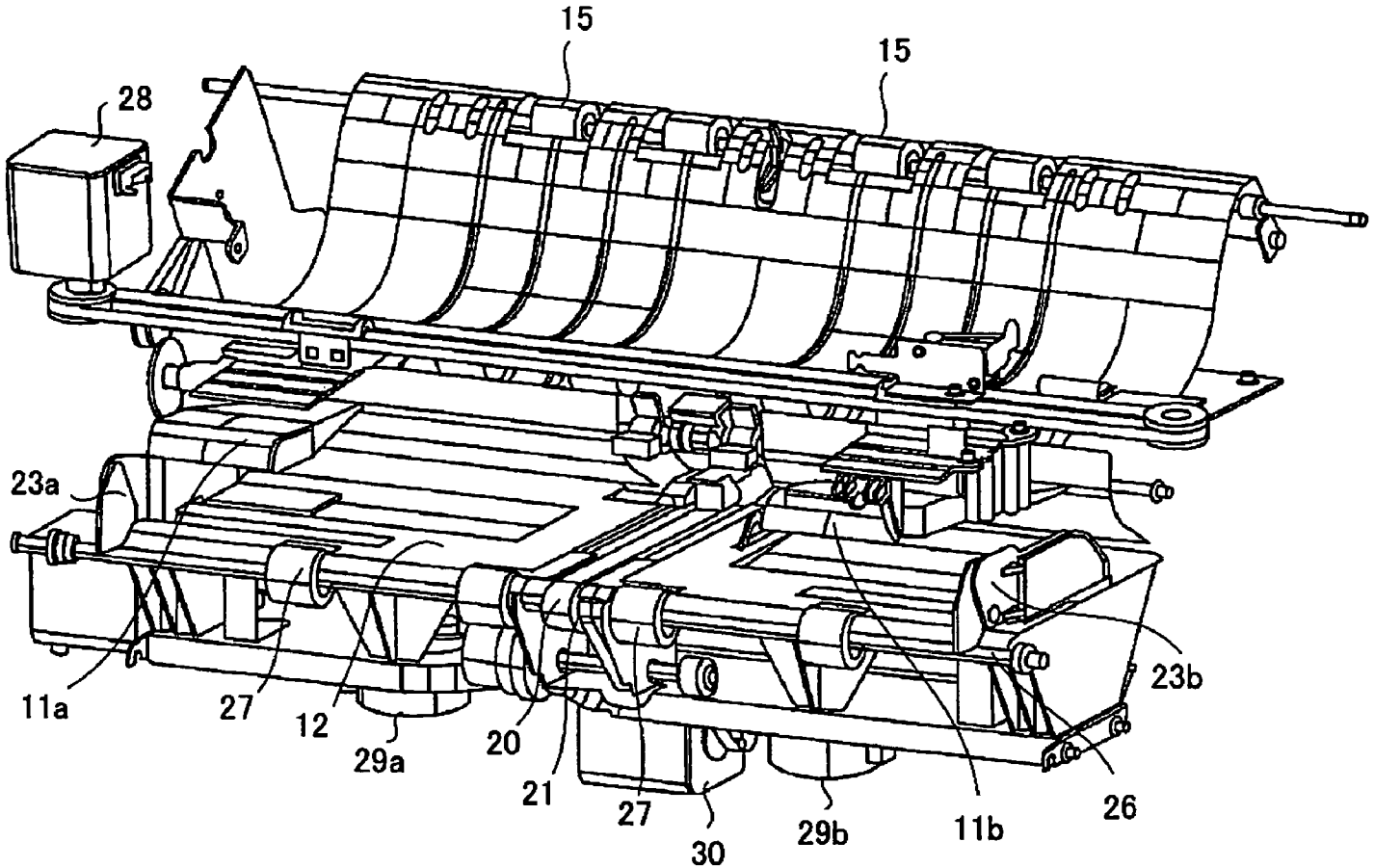
FIG. 3 is a perspective view showing the configuration of the periphery of a processing tray, as viewed from a discharge port of the finisher.

FIG. 3 is a perspective view showing essential parts of the stapling unit 10, as viewed from the direction of arrow A in FIG. 2. FIG. 3 mainly shows the standby tray 11, the processing tray 12 and the peripheral mechanism of the tray 11 and 12.

In FIG. 3, a shaft 26 is arranged orthogonally to the direction of conveying of the sheet S. The pulley 21 is attached to an intermediate part of the shaft 26. The conveyance belt 20 is laid over the pulley 21. The conveyance belt 20 is laid between the pulley 21 and the pulley 22 (FIG. 2). The conveyance belt 20 is turned by a motor 30 and circularly turns and moves between the stapler 13 and the discharge port 24 along the direction of discharge of the sheets. Discharge rollers 27 are attached to a central part and both side parts of the shaft 26 and rotate when discharging the sheets S to the storage tray 61.

The standby tray 11 has a pair of tray members 11*a* and 11*b* and supports both ends of the sheets S in the direction of the width. The tray members 11*a* and 11*b* can be moved in the direction of the width of the sheets S by a motor 28. The lateral alignment unit 23 is provided on the processing tray 12. The lateral alignment unit 23 includes a pair of alignment boards 23*a* and 23*b* provided on both sides of the processing tray 12. The tray members 11*a* and 11*b* and the alignment boards 23*a* and 23*b* are slidable in the direction of the width of the sheets. The alignment boards 23*a* and 23*b* align the sheets falling from the tray members 11*a* and 11*b*. The alignment boards 23*a* and 23*b* are moved parallel to the shaft 26 by motors 29*a* and 29*b*.

Figure 4:
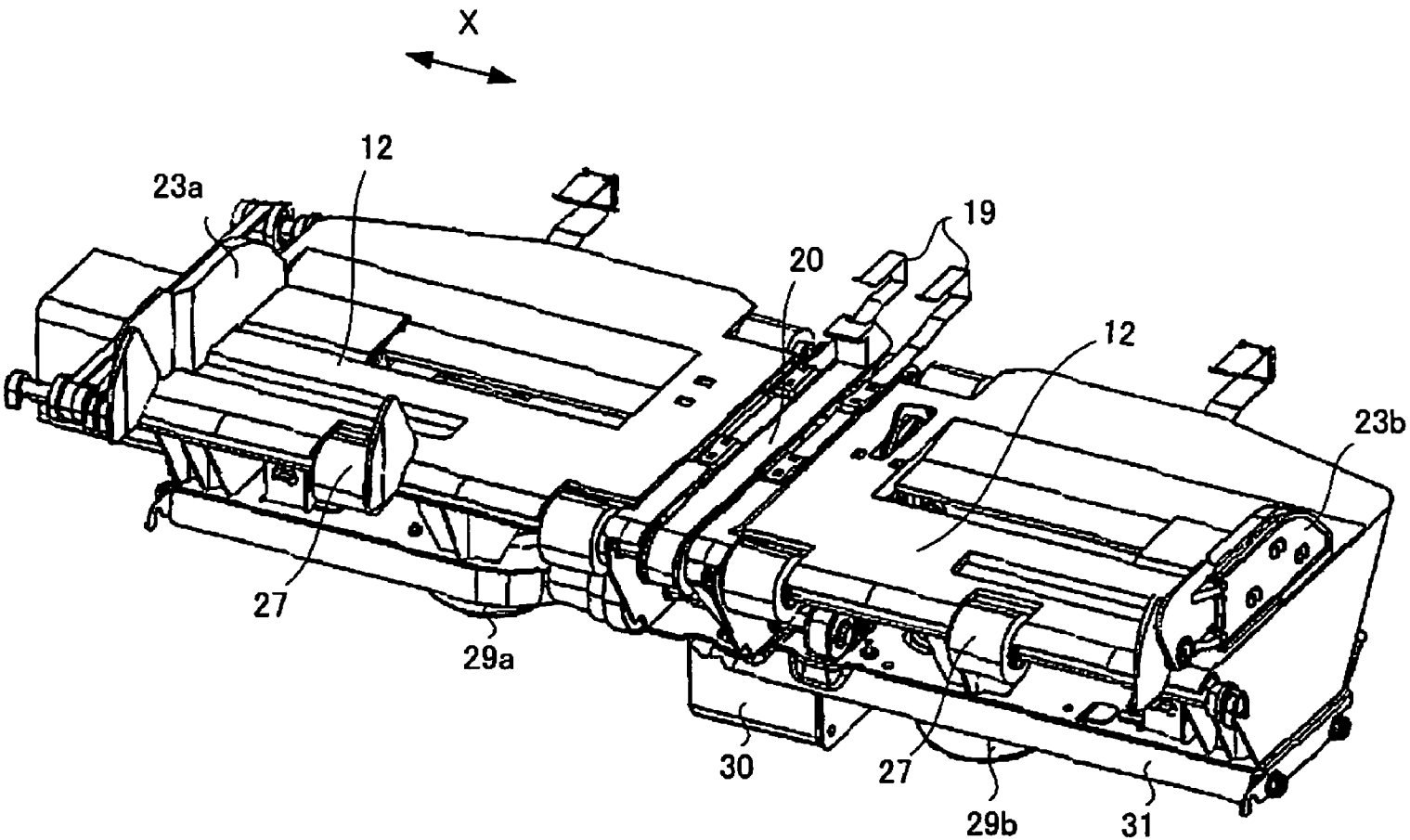
FIG. 4 is a perspective view showing the configuration of the processing tray and a conveyance belt.

FIG. 4 is a perspective view showing the configuration of the peripheries of the processing tray 12, the conveyance belt 20 and the alignment boards 23*a* and 23*b*. On both sides of the processing tray 12, the alignment boards 23*a* and 23*b* are provided movably in the direction of arrow X. The conveyance belt 20 is provided at a central part of the processing tray 12. The motor 30 which drives the conveyance belt 20, and the motors 29*a* and 29*b* which drive the alignment boards 23*a* and 23*b* in the direction of arrow X are attached to a frame 31.

Figure 5:
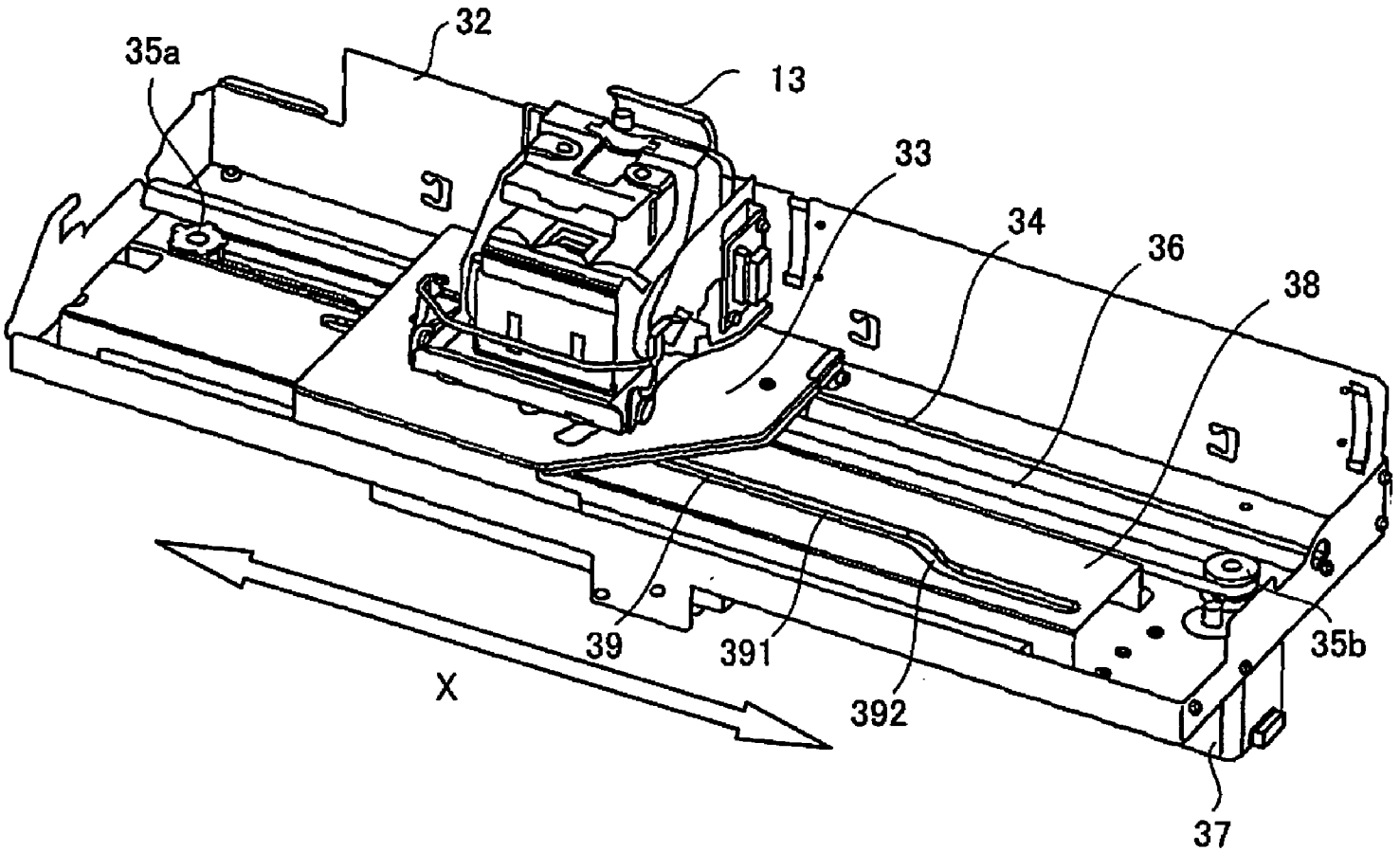
FIG. 5 is a perspective view showing the configuration of a stapler.

FIG. 5 is a perspective view showing the configuration of the stapler 13. The stapler 13 is attached onto a moving plate 33 housed in a frame 32. The moving plate 33 moves along a rail 34. In order to move the moving plate 33, an endless belt 36 is laid between pulleys 35*a* and 35*b* and the endless belt 36 is fixed to the moving plate 33. As the pulley 35*b* is rotated forward and backward by a motor 37, the moving plate 33 moves in the direction of arrow X.

A table 38 is provided parallel to the endless belt 36. A slit 39 is formed in the table 38. The slit 39 has a linear part 391 extending parallel to the rail 34, and an inclined part 392. The stapler 13 is rotatably attached to the moving plate 33 and a pin provided on the bottom part of the stapler 13 is inserted in the slit 39.

While the moving plate 33 is moving through the linear part 391 of the slit 39, the rear end of the sheets (for example, at two positions) can be stapled. Also, when the moving plate 33 is moved to the position of the inclined part 392 of the slit 39 and the pin reaches the position of the inclined part 392, the stapler 13 rotates substantially 45 degrees and can staple the sheets at a corner of the sheets. When the stapler 13 is moved to the right in FIG. 5, the stapler 13 can staple the sheets S at aright corner of the sheets. When the stapler 13 is moved to the left in FIG. 5, the stapler 13 can staple the sheets at a left corner of the sheets.

Figure 6:
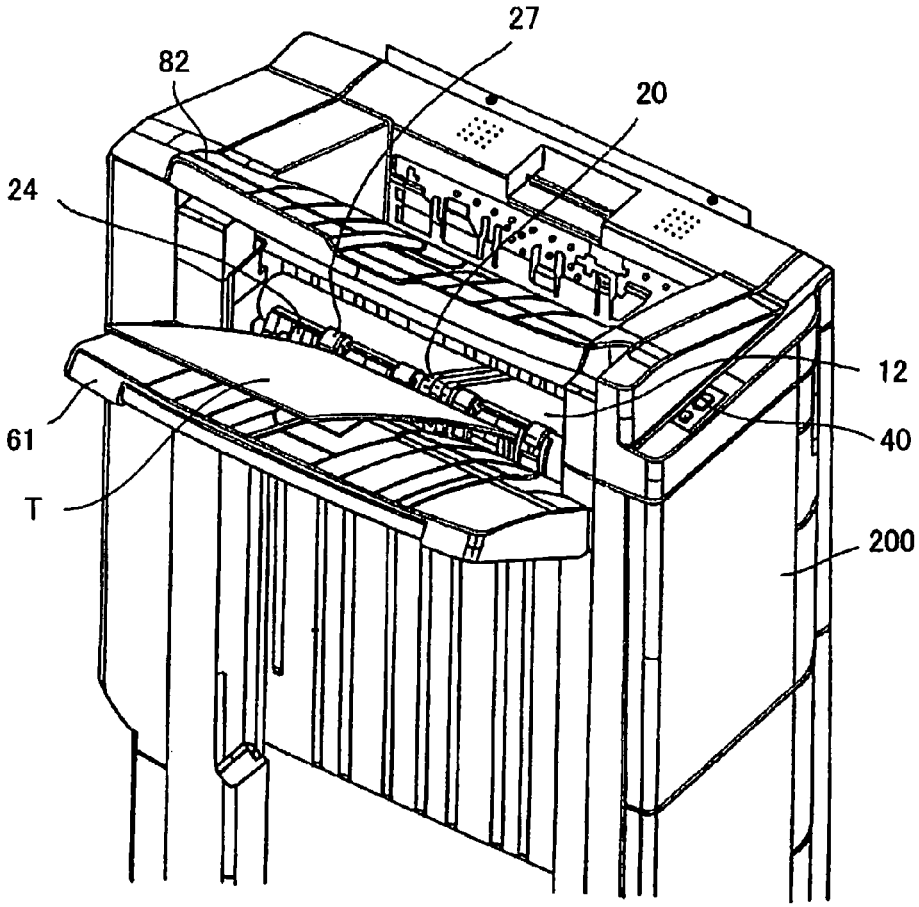
FIG. 6 is a perspective view showing an example of inserting a sheet in manual stapling.

Although the sheets S conveyed from the MFP 100 can be stapled by the stapler 13, the sheets S can also be stapled by the user's manual operation using the stapler 13. Hereinafter, the manual operation is called manual mode. That is, in the manual mode, as shown in FIG. 6, the user insets a sheet bundle T from the discharge port 24 toward the processing tray 12. An operation panel 40 for manual stapling is provided in an upper part of the finisher 200.

Figure 7:
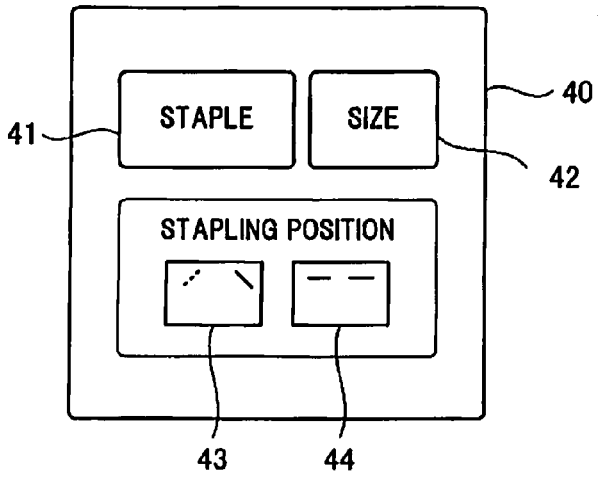
FIG. 7 is a plan view showing an example of an operation panel for manual stapling.

FIG. 7 is a plan view showing an example of the operation panel 40. The operation panel 40 includes a stapling button 41, a size selection button 42, and selection buttons 43 and 44 to designate the stapling position. The buttons 41 to 44 are LED-lighting buttons. For example, when the stapling button 41 is pressed, the stapling button 41 and the size button 42 are lit up. When a sheet size is selected via the size button 42, the selection buttons 43 and 44 are lit up. When a stapling position is selected by the operation of the selection buttons 43 and 44, the stapling button 41 flashes on and off. Then, as the stapling button 41 is pressed, stapling by the stapler 13 is executed.

When, the stapling button 41 on the operation panel 40 is pressed, the storage tray 61 moves up so that the top surface of the storage tray 61 becomes flush with the surface of the processing tray 12. As shown in FIG. 6, when the sheet bundle T is inserted from the discharge port 24, the sheet bundle T falls down to the stapler 13 from the processing tray 12. The fallen sheets are stapled in response to the operation of the operation panel 40.

Meanwhile, in the manual mode, in some cases, the sheet bundle T cannot be correctly stapled because the sheet bundle is not aligned or the inserting position is shifted when inserting the sheet bundle T toward the stapler 13 from the discharge port 24 of the finisher. In the finisher 200 according to the embodiment, in manual stapling, the alignment boards 23*a* and 23*b* are moved to enable positioning and alignment of the sheet bundle.

Figure 8:
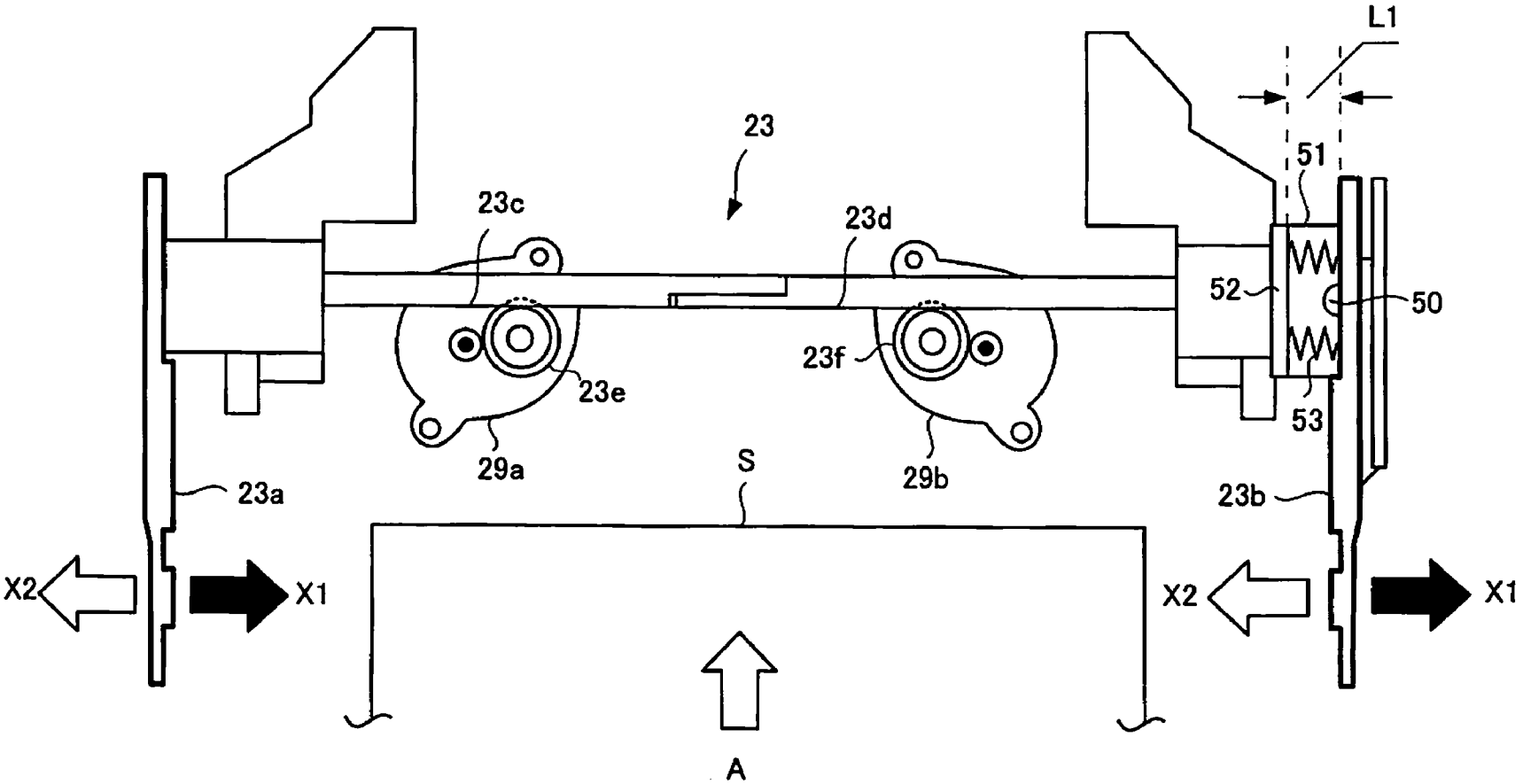
FIG. 8 is a plan view of a lateral alignment unit.

FIG. 8 is a plan view showing the lateral alignment unit 23. The lateral alignment unit 23 has the pair of alignment boards 23*a* and 23*b* arranged on both sides of the processing tray 12, racks 23*c* and 23*d* connected to the alignment boards 23*a* and 23*b*, and gears 23*e* and 23*f* meshing with the racks 23*c* and 23*d*.

The motors 29*a* and 29*b* are provided in order to rotate the gears 23*e* and 23*f*. The rotation of the motor 29*a* rotates the gear 23*e* and moves the rack 23*c*, moving the alignment board 23*a* in the direction of arrow X1 or X2. The rotation of the motor 29*b* rotates the gear 23*f* and moves the rack 23*d*, moving the alignment board 23*b* in the direction of arrow X1 or X2. The alignment board 23*a* and 23*b* move independently of each other in the direction orthogonal to the sheet conveying direction.

When stepping motors are used as the motors 29*a* and 29*b*, the moving distance of the alignment boards 23*a* and 23*b* can be set by managing the number of rotations of motors 29*a* and 29*b*, that is, the number of pulses.

A sensor 50 is attached to the inner side of the alignment board 23*b* (the surface contacting the sheets S). A plate 52 provided at a position facing the alignment board 23*b* and away from the alignment board 23*b* by a predetermined distance L1. A spring 53 is provided between the plate 52 and the alignment board 23*b*. The plate 52 and the spring 53 form a damper 51. The plate 52 can move against the spring 53 within the range of the distance L1. The sensor 50 operates when the plate 52 of the damper 51 is pushed toward the alignment board 23*b*. For example, a pressure sensor is used as the sensor 50.

In the manual mode, the lateral alignment unit 23 controls the positions of the alignment boards 23*a* and 23*b* by the rotation of the motors 29*a* and 29*b* and aligns the sheet bundle T inserted from the discharge port 24. The rotation control of the motors 29*a* and 29*b* is performed by a finisher control unit 201 (as will be described later).

Figure 9:
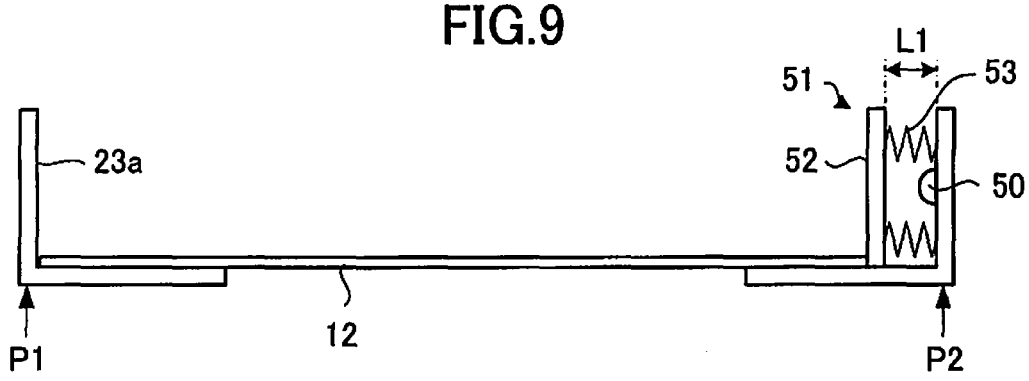
FIG. 9 is a schematic configuration view showing the lateral alignment unit, as viewed from the discharge port side.

FIG. 9 is a schematic configuration view showing the alignment boards 23*a* and 23*b*, as viewed from the discharge port 24 side. The alignment boards 23*a* and 23*b* are situated at their respective standby positions P1 and P2. The plate 52 is situated by the spring 53 at the position away from the alignment board 23*b* by the distance L1. The sensor 50 is not operating.

FIG. 10A to FIG. 10H are explanatory views showing the alignment of the sheet bundle T in the manual mode. The alignment boards 23*a* and 23*b* are moved by the rotation of the motors 29*a* and 29*b*. As the motors 29*a* and 29*b* are rotated forward or backward, the direction of the movement of the alignment boards 23*a* and 23*b* is changed. In FIG. 10A to FIG. 10H, the sheets are aligned by mainly moving the alignment board 23*a* in relation to the alignment board 23*b* as a reference.

Figure 10A:
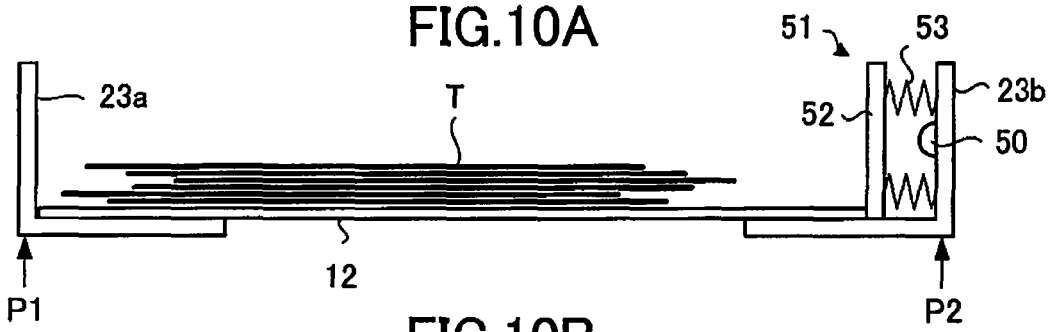
FIG. 10A to FIG. 10H are explanatory views showing alignment of a sheet bundle in manual stapling.
Figure 10B:
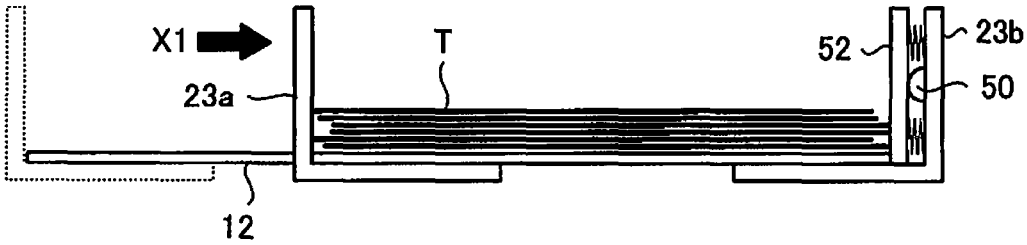

In the initial state shown in FIG. 10A, the alignment board 23*a* is situated at a standby position P1 and the alignment board 23*b* is situated at a standby position P2, and the alignment board 23*a* and 23*b* are away from each other. The sheet bundle T can be inserted between the alignment boards 23*a* and 23*b* with enough space. In FIG. 10B, the alignment board 23*a* moves toward the alignment board 23*b* (in the direction of arrow X1) and the sheet bundle T moves to a position where the sheet bundle T is abutted against the plate 52 to operate the sensor 50. The sheet bundle T is held between the alignment boards 23*a* and 23*b* and the first alignment is performed.

As the sensor 50 operates, the alignment board 23*a* stops moving and thus prevents the sheet bundle T from bending. When the sheet bundle T is pushed toward the alignment board 23*b*, the spring 53 causes the plate 52 to push back the sheet bundle T. Therefore, the sheet bundle T is pushed to such an extent that the sheet bundle slightly flexes, and the sheet bundle T can be smoothly aligned.

Figure 10C:
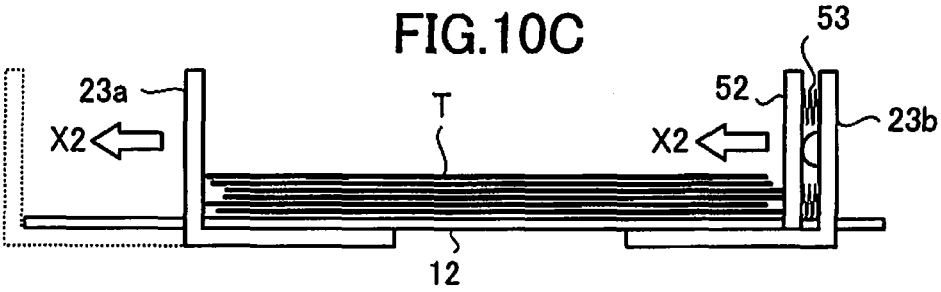
Figure 10D:
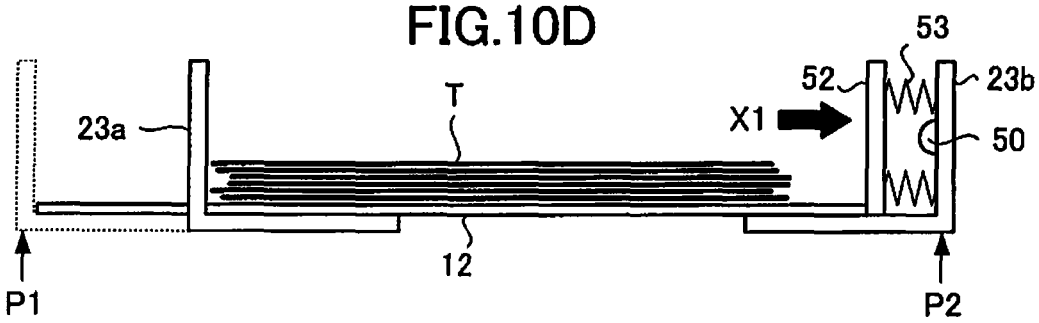
Figure 10E:
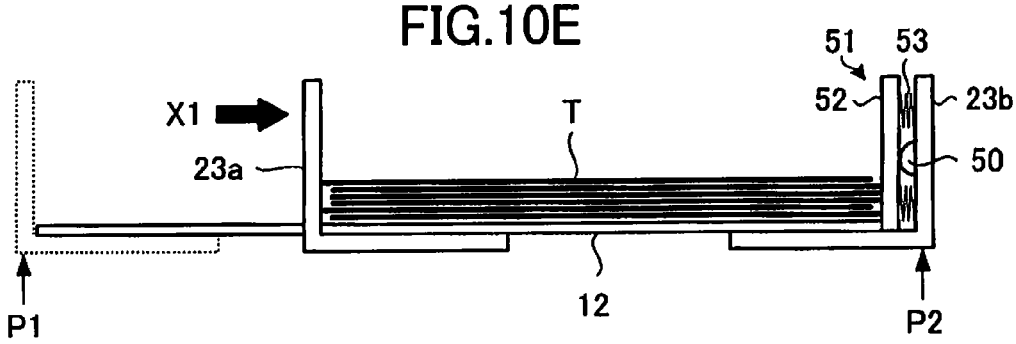

In FIG. 10C, the alignment boards 23*a* and 23*b* move in the reverse direction (the direction of arrow X2) while still holding the bundle sheet T between the alignment boards 23*a* and 23*b*, and then stop before the standby position P1. In FIG. 10D, only the alignment board 23*b* moves in the direction of arrow X1 and returns to the standby position P2. In FIG. 10E, the alignment board 23*a* moves again in the direction of arrow X1 and the sheet bundle T moves to the position where the sheet bundle T is abutted against the plate 52 to operate sensor 50. The sheet bundle T is held between the alignment boards 23*a* and 23*b* and the second alignment is performed.

Figure 10F:
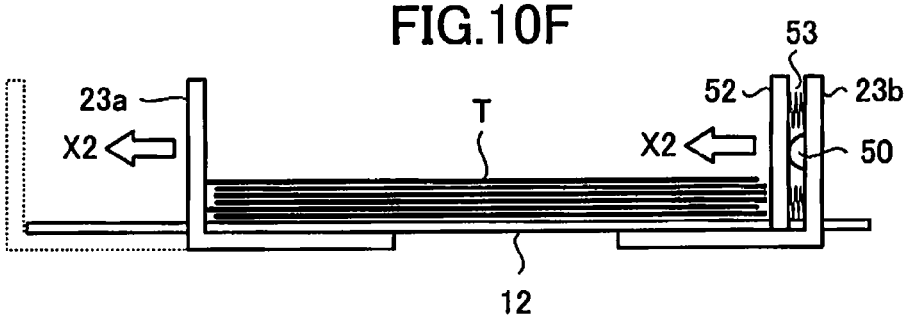
Figure 10G:
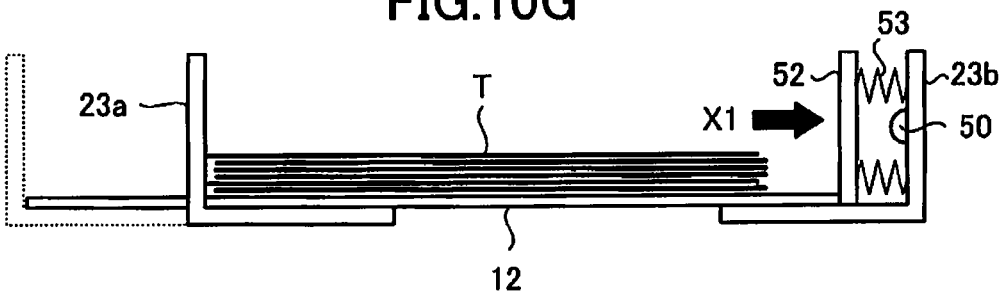
Figure 10H:
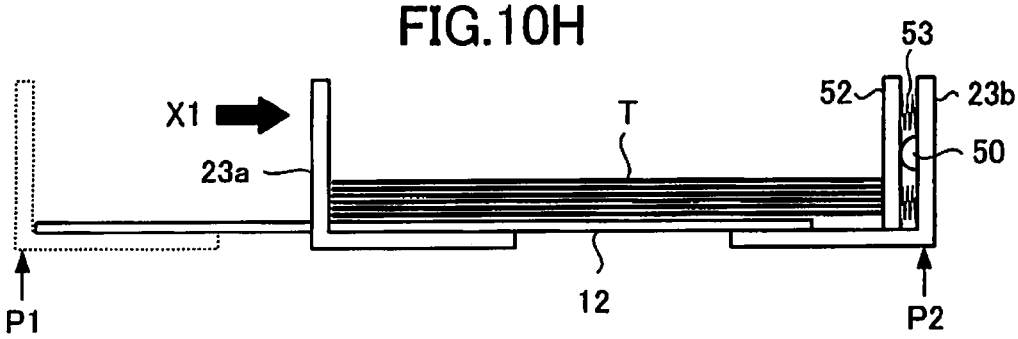

In FIG. 10F, the alignment boards 23*a* and 23*b* move in the direction of arrow X2 while still holding the sheet bundle T between the alignment boards 23*a* and 23*b*, and then stops before the standby position P1. In FIG. 10G, only the alignment boards 23*b* moves in the direction of arrow X1 and returns to the standby position P2. In FIG. 10H, the alignment board 23*a* moves in the direction of arrow X1 and the sheet bundle T moves to the position where the sheet bundle T is abutted against the plate 52 to operate the sensor 50. The sheet bundle T is held between the alignment boards 23*a* and 23*b* and the third alignment is performed.

How many times alignment is performed is set in advance. Alternatively, the number of times of alignment may be set according to the size of the sheets S. Also, the user may set the number of times of alignment. For example, a button to set the number of times of alignment may be provided on the operation panel 40 and the user may set the number of times of alignment, considering the size of the sheets S, the hardness of the sheets (soft paper or hard paper), the thickness of the sheet bundle T and the like.

Figure 11:
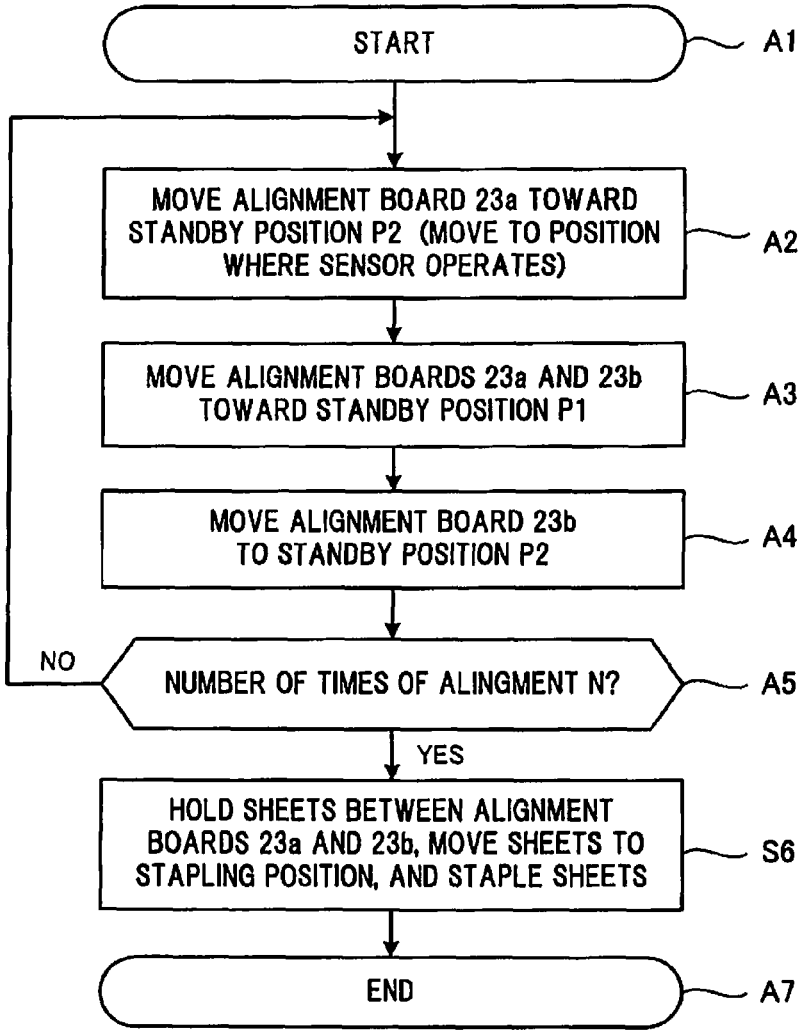
FIG. 11 is a flowchart showing the alignment shown in FIG. 10A to FIG. 10H.

FIG. 11 is a flowchart showing the alignment shown in FIG. 10A to FIG. 10H. In Act A1 in FIG. 11, which represents the start of manual stapling, the sheet bundle T is inserted between the alignment boards 23*a* and 23*b* (see FIG. 10A).

In Act A2, the alignment board 23*a* is moved toward the standby position P2 (in the direction of arrow X1) and is moved to the position where the sensor 50 operates (see FIG. 10B). In Act A3, the alignment boards 23*a* and 23*b* are moved toward the standby position P1 (in the direction of arrow X2) and are stopped before the standby position P1 (see FIG. 10C). In Act A4, only the alignment board 23*b* is moved to the standby position P2 (see FIG. 10D).

In Act A5, determined whether the alignment is performed the preset number of times (N) or not. When the result is negative (NO), the processing returns to Act A2 to repeat the alignment. When the alignment is performed the preset number of times (N) in Act A5, the processing goes to Act A6. The sheet bundle T is held between the alignment boards 23*a* and 23*b* and is moved to the stapling position. After the sheet bundle is stapled, the processing ends in Act A7.

That is, when manual stapling, the finisher control unit 201 performs control so that the inserted sheet bundle T is stapled after an operation of holding the sheet bundle T between the pair of alignment boards 23*a* and 23*b* and then opening the alignment boards is performed plural times, as shown in FIG. 10A to FIG. 10H.

Figure 12:
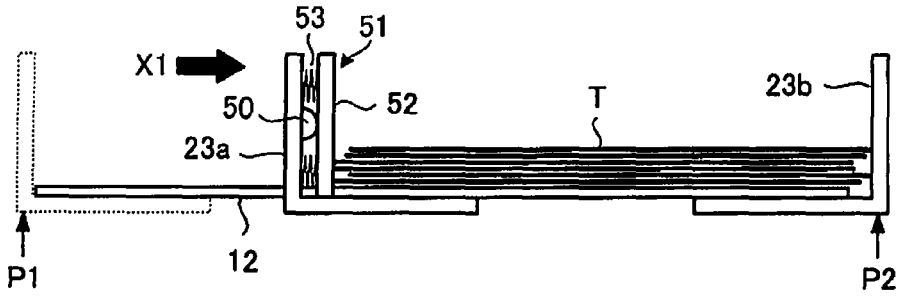
FIG. 12 is a schematic configuration view showing a modification of the lateral alignment unit.

In FIG. 10A to FIG. 10H, the example in which the damper 51 and the sensor 50 are attached to the alignment board 23*b* is described. However, the damper 51 and the sensor 50 may be attached to the side of the alignment board 23*a*, as shown in FIG. 12. Similar alignment to the alignment shown in FIG. 10A to FIG. 10H can be performed in the example shown in FIG. 12 as well.

FIG. 13A to FIG. 13F are explanatory views showing another example of the alignment of the sheet bundle T in the manual mode. In FIG. 13A to FIG. 13F, the alignment is performed by moving the alignment board 23*b* in relation to the alignment board 23*a* as a reference.

Figure 13A:
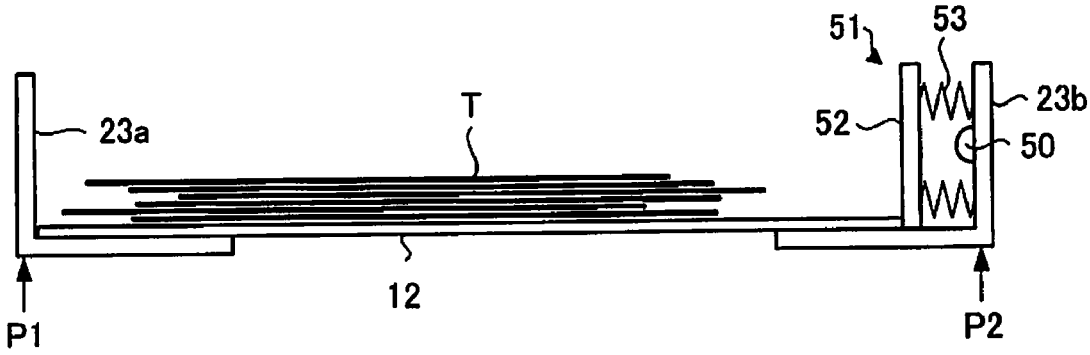
FIG. 13A to FIG. 13F are explanatory views showing another example of the alignment of a sheet bundle in manual stapling.
Figure 13B:
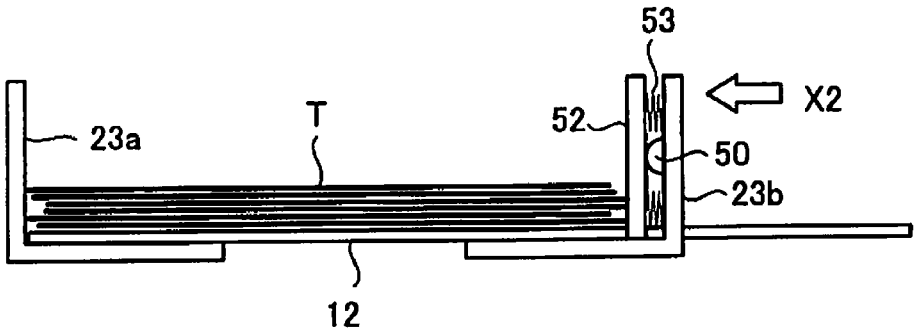

In the initial state shown in FIG. 13A, the alignment board 23*a* is situated at the standby position P1 and the alignment board 23*b* is situated at the standby position P2, and the alignment board 23*a* and 23*b* are away from each other. The sheet bundle T can be inserted between the alignment boards 23*a* and 23*b* with enough space. In FIG. 13B, the alignment board 23*b* moves toward the alignment board 23*a* (in the direction of arrow X2) and the sheet bundle T moves to the position where the sheet bundle T is abutted against the plate 52 to operate the sensor 50. The sheet bundle T is held between the alignment boards 23*a* and 23*b* from both sides and the first alignment is performed.

Figure 13C:
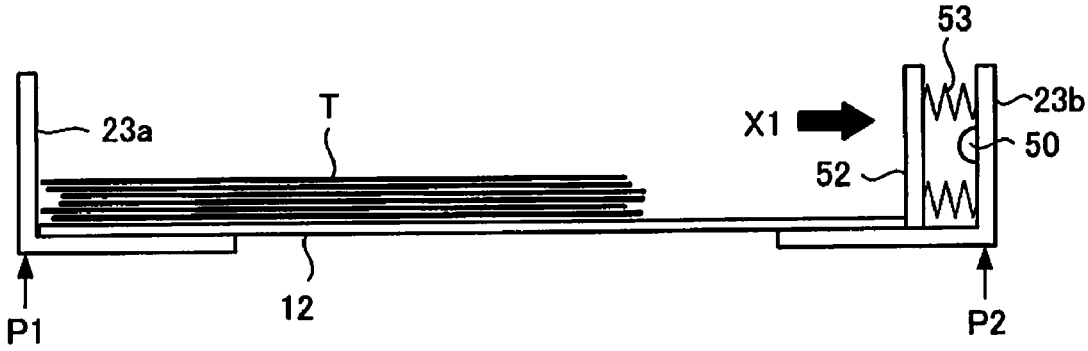
Figure 13D:
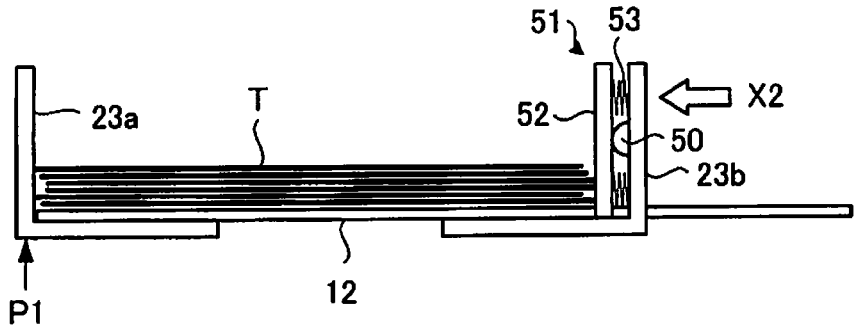

In FIG. 13C, the alignment board 23*b* returns to the standby position P2. In FIG. 13D, the alignment board 23*b* moves again in the direction of arrow X2 and the sheet bundle T moves to the position where the sheet bundle T is abutted against the plate 52 to operate sensor 50. The sheet bundle T is held between the alignment boards 23*a* and 23*b* from both sides and the second alignment is performed.

Figure 13E:
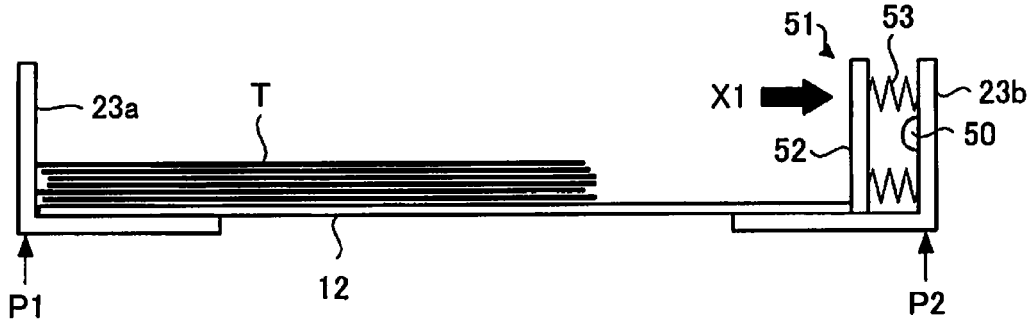
Figure 13F:
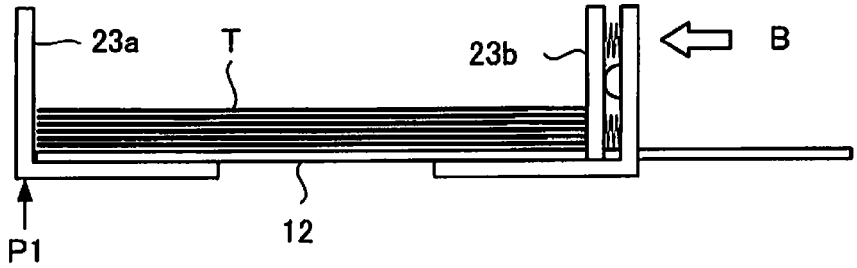

In FIG. 13E, the alignment board 23*b* moves in the direction of arrow X1 and returns to the standby position P2. In FIG. 13F, the alignment board 23*b* moves in the direction of arrow X2 and the sheet bundle T moves to the position where the sheet bundle T is abutted against the plate 52 to operate the sensor 50. The sheet bundle T is held between the alignment boards 23*a* and 23*b* from both sides and the third alignment is performed. How many times alignment is performed is set in advance. Alternatively, the number of times of alignment may be set according to the size of the sheets S. Also, the user may set the number of times of alignment.

Figure 14:
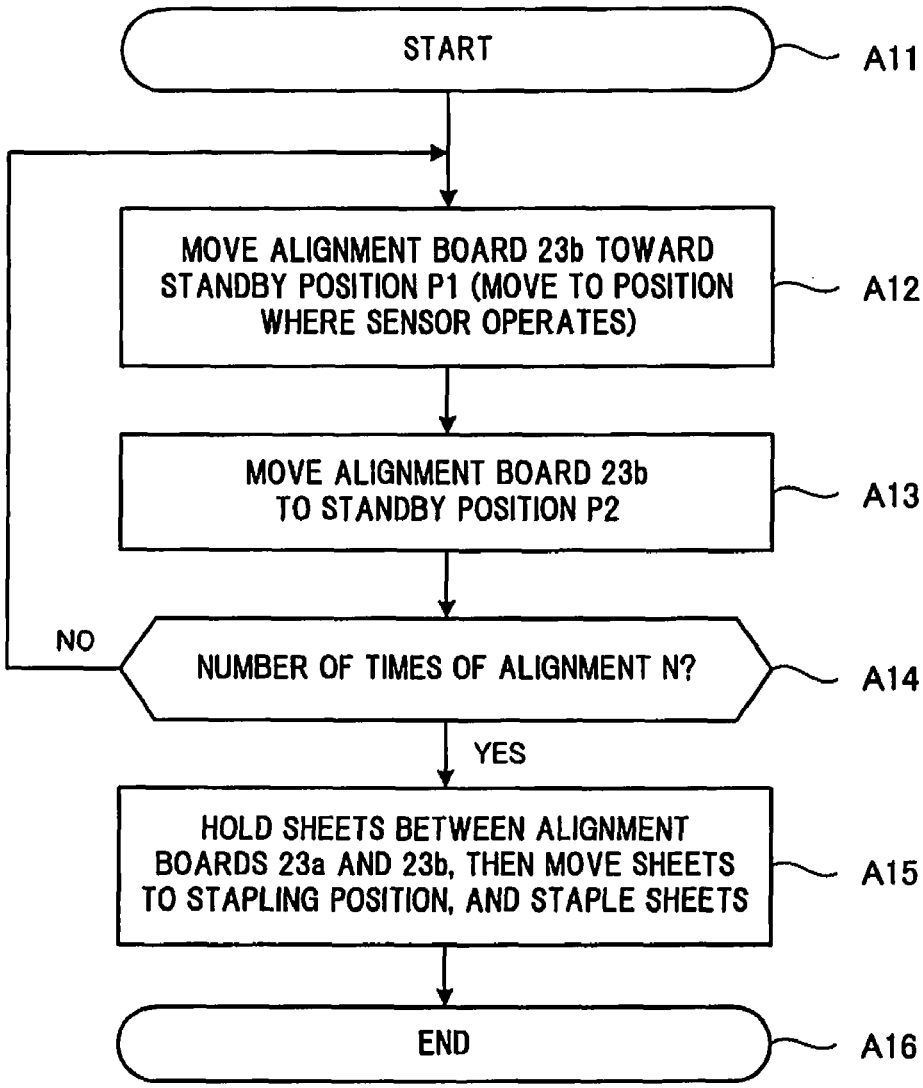
FIG. 14 is a flowchart showing the alignment shown in FIG. 13A to FIG. 13F.

FIG. 14 is a flowchart showing the alignment shown in FIG. 13A to FIG. 13F. In Act A11 in FIG. 14, which represents the start of manual stapling, the sheet bundle T is inserted between the alignment boards 23*a* and 23*b* (see FIG. 13A). In Act A12, the alignment board 23*b* is moved toward the standby position P1 (in the direction of arrow X2), then moved to the position where the sensor 50 operates, and the sheet bundle is aligned (see FIG. 13B). In Act A13, the alignment board 23*b* is moved to the standby position P2.

In Act A14, determined whether the alignment is performed the preset number of times (N) or not. When the result is negative (NO), the processing returns to Act A12 to repeat the alignment. When the alignment is performed the preset number of times (N) in Act A14, the processing goes to Act A15. The sheet bundle T is held between the alignment boards 23*a* and 23*b* and is moved to the stapling position. After the sheet bundle is stapled, the processing ends in Act A16.

That is, when manual stapling, the finisher control unit 201 performs control so that the inserted sheet bundle T is stapled after the operation of holding the sheet bundle T between the pair of alignment boards 23*a* and 23*b* and then opening the alignment boards is performed plural times, as shown in FIG. 13A to FIG. 13F.

Figure 15:
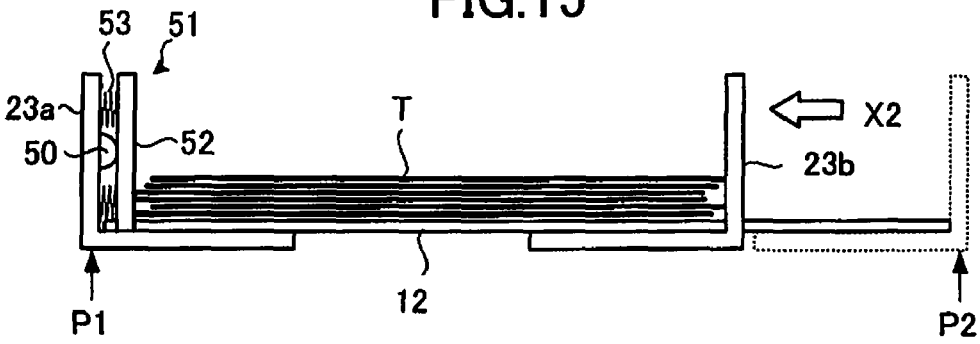
FIG. 15 is a schematic configuration view showing another modification of the lateral alignment unit.

In FIG. 13A to FIG. 13F, the example in which the damper 51 and the sensor 50 are attached to the alignment board 23*b* is described. However, the damper 51 and the sensor 50 may be attached to the side of the alignment board 23*a*, as shown in FIG. 15. Similar alignment to the alignment shown in FIG. 13A to FIG. 13F can be performed in the example shown in FIG. 15 as well.

Figure 16:
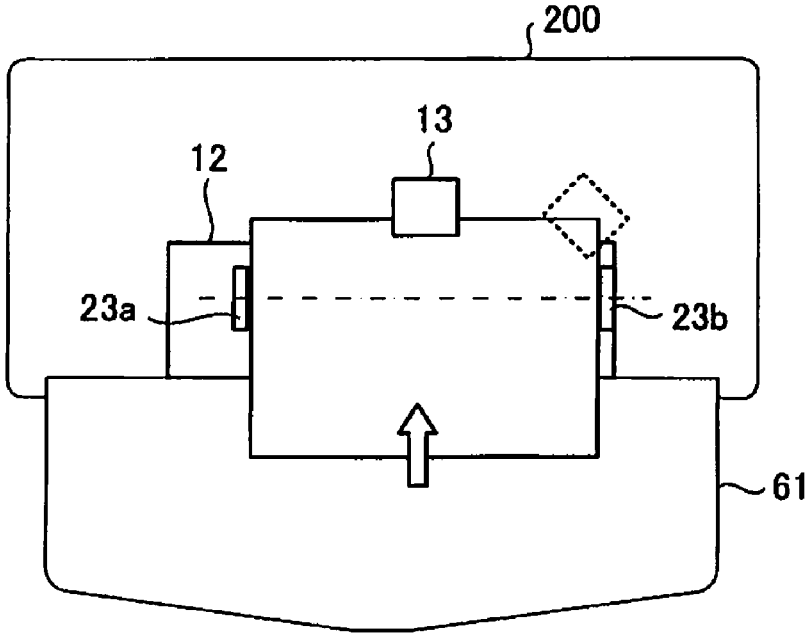
FIG. 16 is a plan view showing stapling after alignment is performed as shown in FIG. 10H.

FIG. 16 is a plan view showing how stapling is performed after alignment is performed as shown in FIG. 10H. The alignment board 23*b* is situated at the standby position P2 and the sheet bundle T is pushed toward the alignment board 23*b* by the alignment board 23*a*.

When the sheet bundle T is to be stapled at a corner (right corner) of the sheet bundle T, the stapler 13 is moved along the slit 39 as shown in FIG. 5 and the sheet bundle T is stapled at the corner. When the sheet bundle T is to be stapled at two positions on the edge, the stapler 13 is moved to the center while the sheet bundle T is still held between the alignment boards 23*a* and 23*b*, and the sheet bundle T is stapled by the staple 13 at two positions on both sides of the center position.

Figure 17:
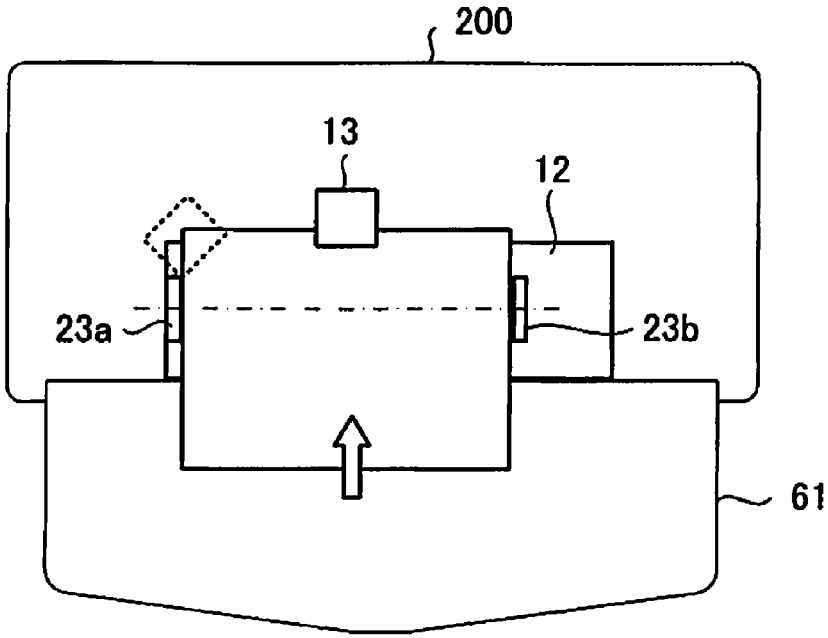
FIG. 17 is a plan view showing stapling after alignment is performed as shown in FIG. 13F.

FIG. 17 is a plan view showing how stapling is performed after alignment is performed as shown in FIG. 13F. The alignment board 23*a* is situated at the standby position P1 and the sheet bundle T is pushed toward the alignment board 23*a* by the alignment board 23*b*.

When the sheet bundle T is to be stapled at the left corner of the sheet bundle T, the stapler 13 is moved along the slit 39 and the sheet bundle T is stapled at the left corner. When the sheet bundle T is to be stapled at two positions on the edge, the stapler 13 is moved to the center while the sheet bundle T is still held between the alignment boards 23*a* and 23*b*, and the sheet bundle T is stapled by the staple 13 at two positions on both sides of the center position. Therefore, the way of alignment can be switched to the processing shown in FIG. 11 or FIG. 14 according to the position of the corner on which the sheet bundle is to be stapled.

In the initial state of manual stapling, the standby positions P1 and P2 are set in such a manner that the alignment boards 23*a* and 23*b* face each other at a distance greater than the width of the inserted sheets. That is, the spacing between the alignment boards 23*a* and 23*b* can be set to be broader than the width of large-sized sheets S. The sheet size can be determined by the operation of the size button 42 on the operation panel 40. By changing the amount of movement of the alignment boards 23*a* and 23*b* according to the sheet size, possible to accurately align sheets even when the sheet size is changed.

Figure 18:
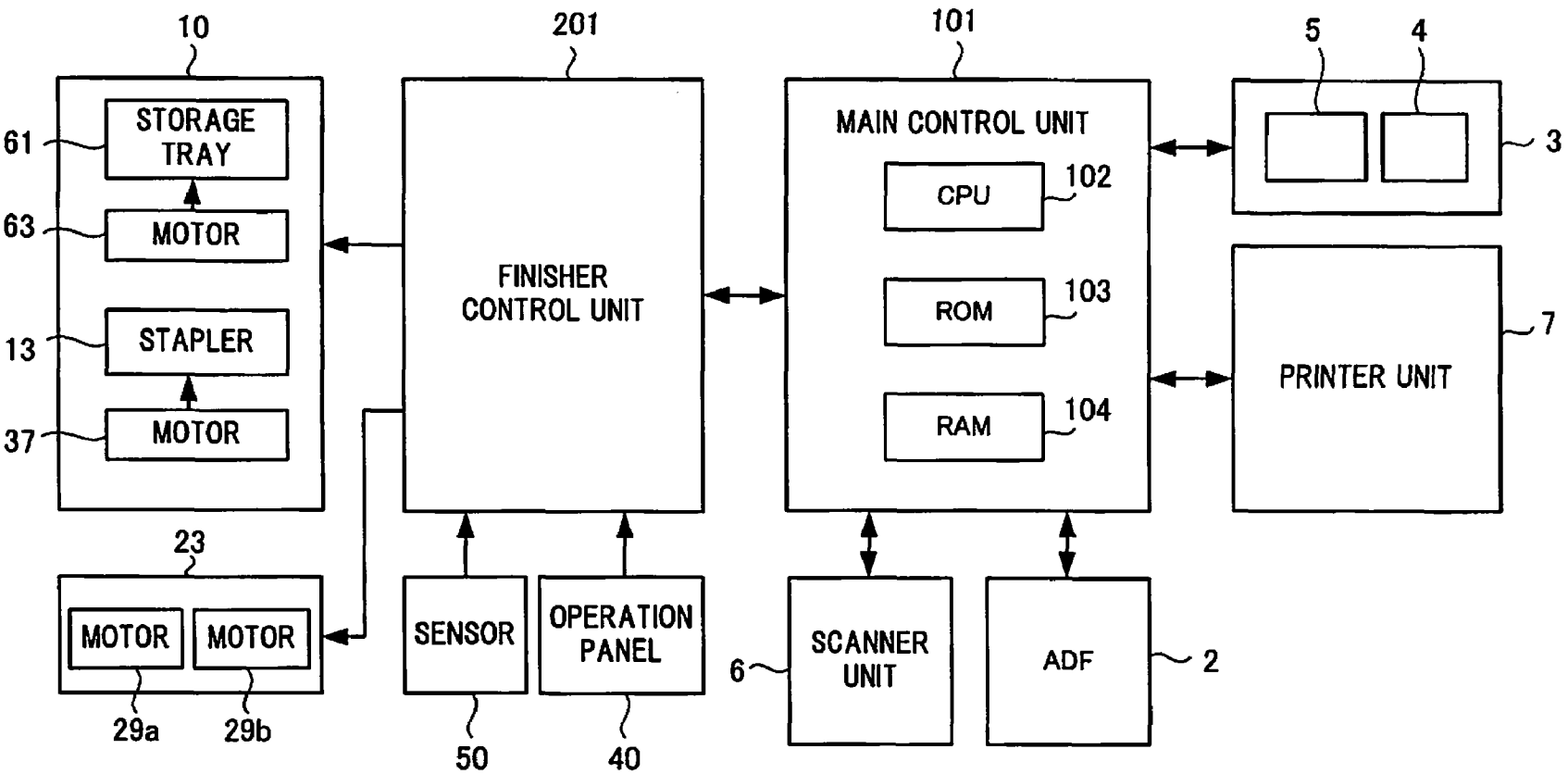
FIG. 18 is a block diagram showing the control system of an image forming apparatus and the finisher.

FIG. 18 is a block diagram showing the control system of the image forming apparatus 100 and the finisher 200. In FIG. 18, a main control unit 101 includes a CPU 102, a ROM 103 and a RAM 104. The CPU 102 controls the image forming apparatus 100 according to a control program stored in the ROM 103. The main control unit 101 also controls the operation of the ADF 2, the scanner unit 6 and the printer unit 7 in response to the operation on the operation panel 3. The RAM 104 is used to temporarily save control data and to performs operation work when control.

The operation panel 3 has plural keys 4 and a display unit 5 which also serves as a touch panel. The operation panel 3 enables various instructions to be given for image formation. For example, an instruction of the number of copies is given using the keys 4. Instructions about sheet size, sheet type, punching, stapling and the like are given by the operation on the touch panel of the display unit 5.

The finisher control unit 201 controls the operation of the finisher 200 (the stapling unit 10) and the sheet discharge operation. The finisher control unit 201 is connected to the main control unit 101 and communicates information with the main control unit 101. The image forming apparatus 100 and the finisher 200 operate in cooperation with each other.

When the stapling button 41 on the operation panel 40 is pressed in the manual mode, the finisher control unit 201 drives the motor 63 to move storage tray 61 up and performs control so that the height of the storage tray 61 coincides with the height of the processing tray 12.

The finisher control unit 201 also drives the motors 29*a* and 29*b* to move the alignment boards 23*a* and 23*b*, thus aligning the sheet bundle T. In the alignment, the finisher control unit 201 controls the movement and stop of the alignment boards 23*a* and 23*b* on the basis of the result of detection by the sensor 50. The finisher control unit 201 also controls the amount of movement of the alignment boards 23*a* and 23*b* according to the sheet size. The alignment is performed a preset number of times. When an instruction about the stapling position is given from the operation panel 40, the finisher control unit 201 controls the position of the stapler 13 and thus executes stapling.

In the above embodiment, when stapling in the manual mode, a sheet bundle can be aligned and thus inserted. Therefore, misalignment of sheets can be prevented when the sheets are stapled.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a processing tray on which sheets conveyed from an image forming apparatus or supplied through a discharge port for manual stapling, are placed;

a lateral alignment unit which has a pair of alignment boards movable in a direction orthogonal to a direction of the conveying, and holds the sheets on the processing tray between the pair of alignment boards and aligns the sheets;

a damper attached to a surface of one alignment board of the pair of alignment boards that is contacted by the sheets;

a sensor which operates if the damper is pushed by the sheets during alignment of the sheet;

a stapler which staples sheets placed on the processing tray;

a sheet discharge unit which discharges the stapled sheets from the processing tray through the discharge port; and a control unit which controls so that the sheets are stapled after an operation of closing the pair of alignment boards until operation of the sensor and then opening the pair of alignment boards, is performed plural times, when the sheets are inserted through the discharge port for manual stapling.

2. The apparatus of claim 1, wherein when the sheets are inserted through the discharge port for manual stapling, the control unit controls the movement of the other alignment board of the pair of alignment boards toward said one alignment board to align the sheets.

3. The apparatus of claim 2, wherein the control unit changes an amount of movement of the other alignment board according to sheet size.

4. The apparatus of claim 1, wherein the sensor comprises a pressure sensor, and the sensor operates to cause the pair of alignment boards to open if the damper is pushed by the sheets by a predetermined amount during alignment of the sheets.

5. The apparatus of claim 1, wherein the damper includes a plate which is arranged at a predetermined distance from the sensor and moves together with the one alignment board, and a spring attached between the plate and the one alignment board.

6. The apparatus of claim 1, wherein the pair of alignment boards face each other with a spacing broader than a width of the sheets, during an initial state of the manual stapling.

7. The apparatus of claim 1, wherein when the sheets are inserted through the discharge port for manual stapling, the control unit, to align the sheets, moves one alignment board toward the other alignment board, moves both alignment boards in opposite directions, returns the other alignment board to its original position, and then moves the one alignment board again toward the other alignment board.

8. The apparatus of claim 1, wherein when the sheets are inserted through the discharge port for manual stapling, the control unit, to align the sheets, moves the other alignment board toward the one alignment board, returns the other alignment board to an original position, and then moves the other alignment board again toward the one alignment board.

9. The apparatus of claim 1, wherein further comprising an operation panel on which designation of a sheet size and selection of a stapling position for the manual stapling.

10. The apparatus of claim 9, further comprising a storage tray which can move up and down and on which the sheets discharged through the discharge port are placed, wherein the storage tray moves up or down to a position of height of the discharge port when the manual stapling is designated on the operation panel.

11. A sheet processing method comprising:

placing sheets conveyed from an image forming apparatus or inserted through a discharge port, on a processing tray;

providing a pair of alignment boards movable in a direction orthogonal to a direction of the conveying, holding the sheets on the processing tray between the pair of alignment boards, and aligning the sheets;

attaching a damper to a surface of one alignment board of the pair of alignment boards that is contacted by the sheets;

providing a sensor which operates if the damper is pushed by the sheets during alignment of the sheets;

providing a stapler that staples the sheets placed on the processing tray and a discharge port through which the stapled sheets are discharged from the processing tray; and controlling so that the sheets are stapled after an operation of closing the pair of alignment boards until operation of the sensor and then opening the pair of alignment boards, is performed plural times, when the sheets are inserted through the discharge port for manual stapling.

12. The method of claim 11, wherein when the sheets are inserted through the discharge port for manual stapling, the other alignment board of the pair of alignment boards is moved toward said one alignment board to align the sheets.

13. The method of claim 12, wherein an amount of movement of the other alignment board is changed according to sheet size.

14. The method of claim 11, wherein the sensor comprises a pressure sensor, and the sensor operates to cause the pair of alignment boards to open if the damper is pushed by the sheets by a predetermined amount during alignment of the sheets.

15. The method of claim 11, wherein the pair of alignment boards face each other with a spacing broader than a width of the sheets, during an initial state of the manual stapling.

16. The method of claim 11, wherein when the sheets are inserted through the discharge port for manual stapling, to align the sheets, one alignment board is moved toward the other alignment board, both alignment boards are moved in the opposite directions, the other alignment board is returned to an original position, and then the one alignment board is moved again toward the other alignment board.

17. The method of claim 11, wherein when sheets are inserted through the discharge port for manual stapling, to align the sheets, the other alignment board is moved toward the one alignment board, the other alignment board is returned to an original position, and then the other alignment board is moved again toward the one alignment board.

18. The method of claim 11, wherein an operation panel is provided on which designation of a sheet size and selection of a stapling position for the manual stapling, and a storage tray on which the sheets discharged through the discharge port are placed is moved up or down to a position of height of the discharge port when the manual stapling is designated on the operation panel.

* * * * *